US007545241B2

(12) United States Patent
Wakabayashi et al.

(10) Patent No.: US 7,545,241 B2
(45) Date of Patent: Jun. 9, 2009

(54) NANOPARTICLE TRANSMISSION LINE ELEMENT AND METHOD OF FABRICATING THE SAME

(75) Inventors: Yoshiaki Wakabayashi, Tokyo (JP); Hirokazu Tohya, Tokyo (JP); Kouichi Yamaguchi, Kyoto (JP); Akiji Higuchi, Kyoto (JP); Kenji Yamada, Kyoto (JP)

(73) Assignee: NEC Corporation, Tokyo (JP)

( * ) Notice: Subject to any disclaimer, the term of this patent is extended or adjusted under 35 U.S.C. 154(b) by 112 days.

(21) Appl. No.: 10/592,008

(22) PCT Filed: Mar. 11, 2005

(86) PCT No.: PCT/JP2005/004854

§ 371 (c)(1),
(2), (4) Date: Jan. 12, 2007

(87) PCT Pub. No.: WO2005/088762

PCT Pub. Date: Sep. 22, 2005

(65) Prior Publication Data

US 2007/0188275 A1 Aug. 16, 2007

(30) Foreign Application Priority Data

Mar. 11, 2004 (JP) ..... 2004-069120

(51) Int. Cl.
*H01P 3/08* (2006.01)

(52) U.S. Cl. ..... 333/238; 977/701; 977/712; 977/723; 977/773; 977/785

(58) Field of Classification Search ..... 333/238; 977/701, 707, 712, 720, 722, 723, 762, 785, 977/773

See application file for complete search history.

(56) References Cited

U.S. PATENT DOCUMENTS

| | | | | |
|---|---|---|---|---|
| 7,129,097 | B2 * | 10/2006 | Furukawa et al. | 438/1 |
| 7,160,532 | B2 * | 1/2007 | Liu et al. | 423/447.3 |

FOREIGN PATENT DOCUMENTS

| | | | |
|---|---|---|---|
| JP | 7-202518 | A | 8/1995 |
| JP | 2858073 | B2 | 12/1998 |
| JP | 11-273997 | A | 10/1999 |
| JP | 2000-77335 | A | 3/2000 |
| JP | 2001-217639 | A | 8/2001 |
| JP | 2002-110451 | A | 4/2002 |
| JP | 2002-299924 | A | 10/2002 |
| JP | 2003-12377 | A | 1/2003 |

(Continued)

OTHER PUBLICATIONS

E. Hammerstad, et al.; Accurate Models for Microstrip Computer-Aided Design, 1980 IEEE MTT-S Digest, pp. 407-409.

*Primary Examiner*—Benny Lee
(74) *Attorney, Agent, or Firm*—Sughrue Mion, PLLC

(57) ABSTRACT

A microstrip line element is composed of a first electrode layer (10) as a substrate which is more of a metal, a dielectric layer (20) formed by oxidizing, nitriding or oxiynitriding the first electrode layer (10), a conductor layer (30) formed on the dielectric layer (20) and a second electrode layer (40) formed on the conductor layer (30). The conductor layer (30) is composed of at least conductive nanoparticles (32) and a binder resin (31).

6 Claims, 3 Drawing Sheets

FOREIGN PATENT DOCUMENTS

| | | | |
|---|---|---|---|
| JP | 3399432 | B2 | 2/2003 |
| JP | 2003-101311 | A | 4/2003 |
| JP | 2003-124066 | A | 4/2003 |
| JP | 2003-257797 | A | 9/2003 |
| JP | 2004-27134 | A | 1/2004 |
| JP | 3522097 | B2 | 2/2004 |

* cited by examiner

NANOPARTICLE TRANSMISSION LINE ELEMENT AND METHOD OF FABRICATING THE SAME

This application claims priority from PCT Application No. PCT/JP2005/004854 filed Mar. 11, 2005, and from Japanese Patent Application No. 2004-069 120 filed Mar. 11, 2004, which applications are incorporated herein by reference.

TECHNICAL FIELD

This invention relates to the structure of a transmission line element and a fabrication method thereof and, in particular, relates to the structure of a microstrip line and a fabrication method thereof.

BACKGROUND ART

In recent years, the number of LSIs (large scale integrated circuits) mounted in each of electronic systems such as personal computers tends to increase. As a result, in order to stably operate the electronic system, it is necessary to mount on a board many decoupling capacitors adapted for preventing mutual interference between the LSIs. Further, LSIs have been increasing in speed and there are those LSIs whose operating frequencies exceed 1 GHz. On the other hand, there are many cases where low-speed operating LSIs are also still used on the same board. In this case, it is necessary that a plurality of capacitors having different capacitances be combined and mounted on the board for decoupling over a range from low frequency of several tens of kHz to high frequency of approximately several GHz.

In order to satisfy these requirements, there are instances where capacitors exceeding 1000 in number are used, for example, on a server board or the like. This makes component layout on the printed board very difficult.

For solving such a problem, there has been proposed an element called a shield stripline element and having excellent decoupling properties, which takes the place of the capacitor. Such a shield stripline element is disclosed, for example, in Japanese Unexamined Patent Publication No. 2003-101311 (hereinafter, Document 1) or Japanese Unexamined Patent Publication No. 2003-124066 (hereinafter, Document 2).

However, the shield stripline element disclosed in Document 1 or 2 has several problems.

The first problem is that its external shape is large as compared with a conventional chop capacitor or the like. Therefore, not only is it not possible to largely reduce the area occupied by decoupling elements on the printing board, but it cannot be expected that the difficulty of layout is solved.

The second problem is that the decoupling properties degrade when the frequency becomes 100 MHz or more. The main cause of this is that a lead electrode necessary for mounting on a printed board or the like and a conductive polymer used as a material each has a high impedance in a high-frequency range of approximately 100 MHz or more. That is, the lead electrode itself has an inductance. Given that the inductance is L and the frequency is f, its impedance Z is expressed as $Z=j2\pi fL$. Accordingly, as the frequency increases, the impedance of the lead electrode increases. Further, the conductive polymer interposed between a dielectric layer and the electrode also decreases in conductivity in the high-frequency range and serves as a parasitic inductance with high impedance. As a result, the decoupling properties degrade.

SUMMARY OF THE INVENTION

It is an object of this invention to provide a transmission line element that does not exclusively occupy a mounting area on a printed board and has excellent decoupling properties over a wide band from low frequency of approximately several tens of kHz to high frequency of approximately several GHz, and a fabrication method thereof.

It is another object of this invention to provide a transmission line element that can be incorporated in a printed board, and a fabrication method thereof.

A transmission line element according to a preferred mode of this invention comprises a first electrode layer made of a metal and serving as a substrate, a dielectric layer formed by oxidizing, nitriding, or oxynitriding the first electrode layer, a conductor layer formed on the dielectric layer, and a second electrode layer formed on the conductor layer. The conductor layer is composed of at least conductive nanoparticles and a binder resin. The second electrode layer may be omitted and, in this case, the transmission line element comprises the first electrode layer, the dielectric layer, and the conductor layer, wherein the conductor layer is used as the second electrode layer.

The conductor layer comprises a binder layer made of an organic resin such as an acrylic resin or an epoxy resin, a conductive polymer such as polythiophene or polypyrrole, or an organic-inorganic hybrid resin such as polysilane, and the conductive nanoparticles dispersed mutually uniformly with the binder layer. By configuring the conductor layer in the manner as described above, substantially constant conductivity can be exhibited over a wide frequency band and hence it is possible to reduce the frequency dependence of decoupling properties of the transmission line element.

On the other hand, a transmission line element fabrication method according to a preferred mode of this invention forms the conductor layer on the first electrode layer and forms the dielectric layer between the first electrode layer and the conductor layer by carrying out heat treatment at a predetermined temperature. That is, the dielectric layer can be formed simultaneously with the conductor layer by oxidizing, nitriding, or oxynitriding the first electrode layer, thereby enabling simplification of element fabrication processes and reduction in cost of element fabrication. The heat treatment temperature is preferably 250° C. or more and 600° C. or less.

According to this invention, it is possible to fabricate at low cost and obtain a transmission line element that exhibits excellent decoupling properties over the wide band approximately from several tens of kHz to several GHz.

In addition, the transmission line element according to this invention can be incorporated in a printed board and hence, in terms of reduction in the number of components and simplification of mounting layout in the printed-board mounting, and in its turn, in terms of cost reduction of electronic devices and electrical devices, industrial effects are remarkable.

BEST MODE FOR CARRYING OUT THE INVENTION

[Principle]

Figure 1:
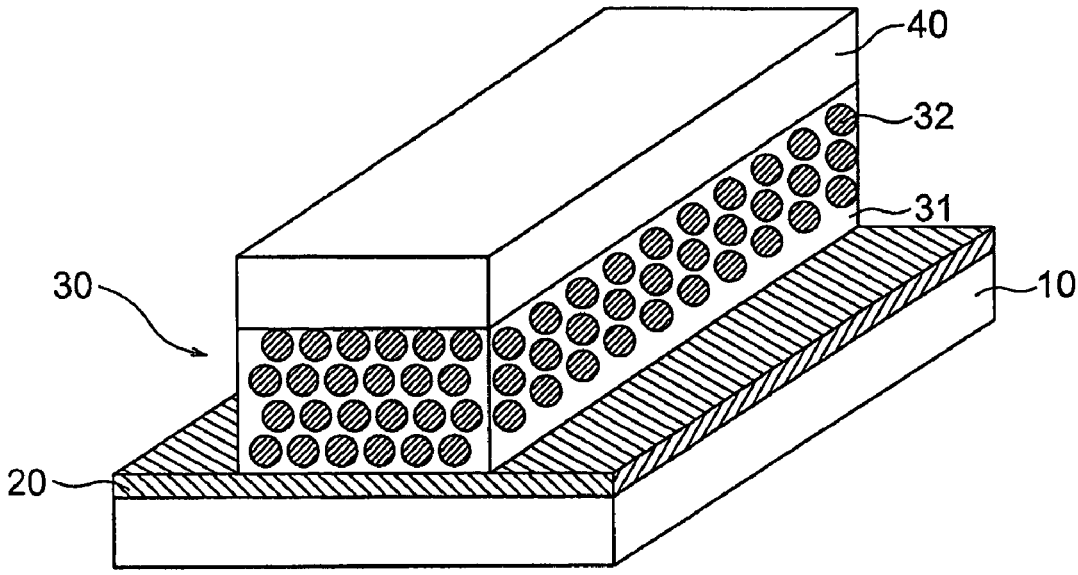
FIG. 1 is a perspective view showing an element according to a first embodiment of this invention.

Prior to description of embodiments of this invention, the principle will be explained.

In order to realize excellent decoupling properties over the wide band from low frequency to high frequency in a transmission line element, it is necessary to reduce parasitic inductance and parasitic resistance caused by a transmission line and further to reduce characteristic impedance of the transmission line. The reason of necessity for reducing the parasitic inductance is as stated before. Further, since a resistance component serves also as an impedance component, as the parasitic resistance increases, the impedance also increases. The increase in impedance leads to degradation of the decoupling properties and, therefore, it is necessary to also reduce the parasitic resistance. Likewise, as the characteristic impedance of the transmission line decreases, more excellent decoupling properties are exhibited.

Normally, a transmission line element such as a microstrip line is constituted by forming, on a first electrode layer, a dielectric layer, a conductor layer, and a second electrode layer in the order named. Given that the width of the conductor layer and the second electrode layer is W, the thickness of the dielectric layer is h, and the relative permittivity of the dielectric layer is $\epsilon_r$ in such a microstrip line, the characteristic impedance Z of the microstrip line when W/h>1 is expressed by the following formulas (e.g. according to E. Hammerstad and O. Jensen: "Accurate Models for Microstrip Computer-Aided Design", 1980 IEEE MTT-S Digest, pp 407-709).

$$Z=(120\pi/\epsilon_{eff}^{1/2})/\{W/h+1.393+0.667\ \ln(W/h+1.444)\}$$

$$\epsilon_{eff}=(\epsilon_r+1)/2+(\epsilon_r-1)/2(1+12h/W)^{1/2}$$

From the above formulas, when the relative permittivity $\epsilon_r$ of the dielectric layer is constant, as W/h increases, i.e. as the thickness h of the dielectric layer decreases relative to the width W of the conductor layer and the second electrode layer, the characteristic impedance of the microstrip line decreases.

As the characteristic impedance decreases, the impedance mismatch increases with respect to a power supply line connected to the transmission line. As a result, the high-frequency power is reflected at an end surface of the transmission line and thus cannot pass through the transmission line. This is exactly the decoupling effect and, therefore, it is necessary to reduce the characteristic impedance of the transmission line. Further, from the formulas of the characteristic impedance of the microstrip line, it is understood that the characteristic impedance is constant with respect to frequency. Therefore, the decoupling effect utilizing this mismatch is effective up to a high-frequency range.

On the other hand, regarding the microstrip line as a capacitor composed of the first electrode layer, the dielectric layer, the conductor layer, and the second electrode layer, W/h being large is nothing but representing that the capacitance of the capacitor is large. As the capacitance of the capacitor increases, the decoupling properties are improved in a low-frequency range where the microstrip line cannot be regarded as a transmission line. Therefore, it can be said that as the characteristic impedance decreases, the decoupling properties of the microstrip line are improved. Specifically, the sufficient decoupling effect can be achieved by reducing the characteristic impedance to approximately 1Ω or less.

In view of the foregoing, in this invention, a wideband decoupling element is realized by reducing the thickness of a dielectric layer and maintaining the conductivity of a conductor layer to be high up to high frequencies.

Referring to FIG. 1, description will be given of the first embodiment wherein this invention is applied to a transmission line element, particularly a microstrip line.

A conductor layer 30 and a second electrode layer 40 are disposed on a first electrode layer 10 through a dielectric layer 20, thereby forming a microstrip line structure. The conductor layer 30 includes a binder layer 31 and conductive nanoparticles 32.

As will be described later, by forming the conductor layer 30 on the surface of the first electrode layer 10, only the constituent substances of the conductor layer exist near the surface of the first electrode layer 10, so that it is possible to exclude oxygen molecules and nitrogen molecules from the vicinity of the surface of the first electrode layer 10. Therefore, oxidation, nitriding, or oxynitriding of the first electrode layer 10 slowly proceeds by oxygen or nitrogen slightly supplied through the conductor layer 30. As a result, the dielectric layer 20 can be formed, by controlling its thickness, to be thin.

With respect to the frequency dependence of conductivity of a resin forming the binder layer 31, any of an organic resin, a conductive polymer, and an organic-inorganic hybrid resin exhibits significant frequency dependence wherein the conductivity decreases particularly in a high-frequency range. However, since the conductivity of the conductive nanoparticles 32 of a metal or a metal oxide is approximately hundreds of thousands of S/cm (Seimens per centimeter) and has almost no frequency dependence, by mutually uniformly dispersing the binder layer 31 and the conductive nanoparticles 32 to form the conductor layer 30, the conductor layer 30 can maintain a substantially-constant high conductivity over a wide frequency range.

Therefore, the transmission line element according to this invention can be formed as a decoupling element for a wide band from several tens of kHz to several GHz.

[Structure]

Figure 2:
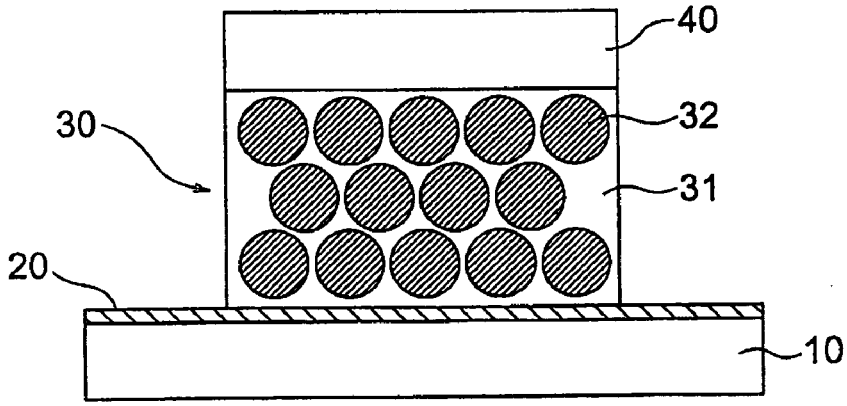
FIG. 2 is a sectional view of the element shown in FIG. 1, FIGS. 3A to 3E are process diagrams showing fabrication processes of the element according to the first embodiment of this invention.

Referring to FIG. 1, the microstrip line is shown as one example of the transmission line element according to this invention. FIG. 2 is a sectional view of FIG. 1, where like elements herein are designated by the same reference numbers as labeled in FIG. 1, and are not further described.

The conductor layer 30 and the second electrode layer 40 are disposed on the first electrode layer 10 through the dielectric layer 20, thereby forming the microstrip line structure. The conductor layer 30 comprises the binder layer 31 made of an organic resin, a conductive polymer, or an organic-inorganic hybrid resin and the conductive nanoparticles 32 dispersed mutually uniformly with the binder layer 31.

The first electrode layer 10 is preferably made of a material whose relative permittivity is high after oxidation, nitriding, or oxynitriding, particularly a material whose relative permittivity is 10 or more after oxidation, nitriding, or oxynitriding, such as, for example, titanium, tantalum, chromium, or niobium. There is no particular limitation to the thickness of the first electrode layer 10. However, in the case where the element according to this invention is incorporated in a printed board, the thickness of the first electrode layer 10 is preferably approximately 10 μm to 100 μm.

The dielectric layer 20 is formed by oxidizing, nitriding, or oxynitriding the first electrode layer 10. As the thickness of the dielectric layer 20 decreases, the characteristic impedance of the microstrip line decreases, and as a result, excellent decoupling properties can be realized. On the other hand, the thickness of the dielectric layer 20 affects the withstand voltage of the microstrip line and, if it is too thin, the withstand voltage is lowered to thereby cause short-circuit failure. Therefore, the thickness of the dielectric layer 20 is preferably approximately 10 nm to 100 nm.

The conductor layer 30 is composed of the binder layer 31 and the conductive nanoparticles 32, wherein the binder layer 31 is used for holding the conductive nanoparticles 32 as a film. In this case, the content of the conductive nanoparticles 32 is preferably 10 wt % or more and less than 100 wt % of the conductor layer 30. Within this range, the binder layer 31 maintains an excellent thin film state and never reduces its conductivity as the binder layer. Further, within the foregoing composition range, the conductivity of the conductor layer 30 can be maintained high up to the high-frequency range and, therefore, the conductivity of the binder layer 31 is not particularly limited. However, the organic resin, the conductive polymer, or the organic-inorganic hybrid resin is preferable because it can be easily formed by the use of a method such as coating. Alternatively, use may be made of an oxidized, nitrided, or oxynitrided organic resin, conductive polymer, or organic-inorganic hybrid resin.

A specific example of the conductive polymer may be polyacetylene, polyphenylene, polyphenylenevinylene, polyacene, polyphenyleneacetylene, polypyrrole, polyaniline, polythienylenevinylene, polyazulene, polyisothianaphthalene, polythiophene, or the like.

The organic-inorganic hybrid resin may be polysilane, an organic silicon compound, an organic titanium compound, an organic aluminum compound, or the like.

The organic resin may be an acrylic resin, an epoxy resin, a phenolic resin, or the like.

In order for the transmission line element of this invention to realize excellent decoupling properties, it is preferable that the conductivity of the conductor layer 30 have only a small frequency dependence and be constant over the entire frequency band.

The conductive nanoparticles 32 are metal particles having a diameter (average particle diameter) of approximately 1 nm to 500 nm and are required to have the property of being capable of being dispersed mutually uniformly with the binder layer 31. Further, the conductive nanoparticles 32 should be uniformly condensed in baking at the entire surfaces so as to be part of an electrode forming the microstrip line along with the second electrode layer 40. A material example suitable for such conditions is at least one of gold, silver, copper, silver oxide, copper oxide, tin oxide, zinc oxide, indium oxide, vanadium oxide, tungsten oxide, molybdenum oxide, niobium oxide, rhodium oxide, osmium oxide, iridium oxide, and rhenium oxide, or a compound in the combination of two or more of them. Since the metal oxide such as the silver oxide or the copper oxide is an insulator as it is, it should be deoxidized to metal in the baking or after the baking.

The second electrode layer 40 is preferably made of a material that is stable alone or that is oxidized or sulfidized at its surface and then becomes stable, such as gold, silver, or aluminum, but is not necessarily limited thereto. On the other hand, when the conductivity of the conductor layer 30 after the baking becomes substantially equal to that of a metal, the effect of this invention is maintained even if the second electrode layer 40 is not formed.

After the formation of the first electrode layer 10 through the second electrode layer 40, the element according to this invention can be incorporated in a laminated printed board.

As is clear from the description so far, in the element according to this invention, the microstrip line is formed on the first electrode layer 10. Therefore, the first electrode layer 10 of the element according to this invention can be formed in the laminated printed board as a wiring layer at a certain layer of the laminated printed board. Since both ends of the microstrip line are used as an input terminal and an output terminal, when, for example, use is made for decoupling a power supply terminal of an LSI, one of the microstrip line ends and the power supply terminal of the LSI are connected together through a via or the like and the other microstrip line end is connected to power supply wiring. By this, it is possible to incorporate the elements according to this invention in the laminated printed board and, therefore, it is no longer necessary to mount decoupling elements such as capacitors hitherto mounted in a large number on a printed board. As a result, it is possible to obtain advantages of not only enabling cost reduction corresponding to the decoupling elements such as the capacitors, but also highly facilitating the layout on the printed board.

Further, it is possible to dispose the element according to this invention in the printed board just under a noise generating source such as an LSI and, therefore, it is unnecessary to draw wiring from the noise generating source to the decoupling element. As a result, since there is no occurrence of noise leakage from the drawing wiring, there is also an advantage that the effective decoupling is enabled.

Moreover, in the case of a conventional surface-mount type decoupling element such as a capacitor, lead wires or electrodes for mounting are invariably required and the parasitic inductance of these lead wires or electrodes degrades high-frequency characteristics of the decoupling element. However, by incorporating the element according to this invention in the printed board, it is no longer necessary to provide the decoupling element with the lead wires or electrodes and, hence, the influence of the parasitic inductance can be eliminated. As a result, it is possible to realize the decoupling properties excellent up to the high-frequency range exceeding GHz.

[Fabrication Method]

Next, referring to FIGS. 3A to 3E, description will be given of a method of fabricating the microstrip line of the first embodiment. FIGS. 3A to 3E are sectional views showing fabrication processes of the microstrip line in the order of process. Identical elements in FIGS. 3A to 3E are designated by the same reference numerals, unless otherwise indicated.

At first, although not illustrated, a mixture for forming the conductor layer 30 is prepared. This mixture is formed by mutually dispersing the organic resin, the conductive polymer, or the organic-inorganic hybrid resin being the material of the binder layer 31 and the conductive nanoparticles 32. A dispersion method may be ultrasonic dispersion, three-roll mill dispersion, or the like, i.e. its technique is not particularly limited, but, the binder and the conductive nanoparticles 32 are dispersed sufficiently uniformly. Herein, if the dispersion is insufficient, the uniform conductor layer 30 cannot be formed.

Figure 3A:
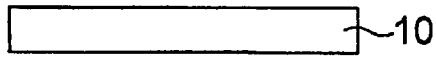
Figure 3B:
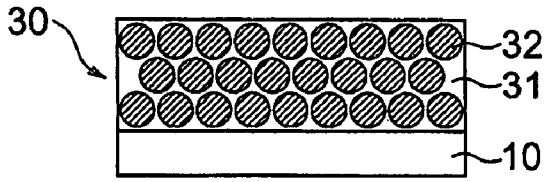

Then, as shown in FIG. 3A, the first electrode layer 10 is prepared. Then, as shown in FIG. 3B, the foregoing mixture for forming the conductor layer 30 is coated on the first electrode layer 10 by any of various wet-type film forming methods such as spin coating, bar coating, and screen printing. Thereafter, the mixture coated on the first electrode layer 10 is baked, thereby forming the conductor layer 30.

Figure 3C:
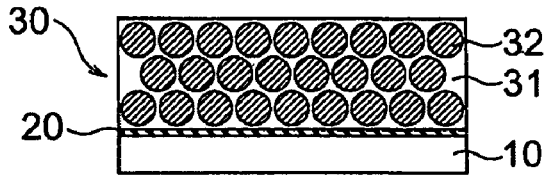

Simultaneously with forming the conductor layer 30, the surface of the first electrode layer 10 contacting the conductor layer 30 is oxidized, nitrided, or oxynitrided, thereby forming the dielectric layer 20 as shown in FIG. 3C. In this event, since the conductor layer 30 is formed on the first electrode layer 10, oxygen molecules or nitrogen molecules are not sufficiently supplied to the surface of the first electrode layer 10. As a result, oxidation, nitriding, or oxynitriding of the surface of the first electrode layer 10 slowly proceeds and, thus, the thickness of the dielectric layer 20 to be obtained can be controlled to be thin. In this event, the constituent matter of the binder layer 31 may be partially oxidized, nitrided, or oxynitrided.

The baking temperature of the conductor layer 30 is preferably 250° C. or more and 600° C. or less. At temperatures less than 250° C., the dielectric layer 20 is formed only partially at the surface of the first electrode layer 10 and thus cannot be a complete film. On the other hand, at temperatures higher than 600° C., the thickness of the dielectric layer 20 formed at the surface of the first electrode layer 10 becomes greater than 100 nm, so that the capacitance of the dielectric layer 20 becomes small. Herein, in the case of the baking temperatures higher than 600° C., if the conductor layer 30 is thickened for maintaining the thickness of the dielectric layer 20 to be formed, at a desired value, the conductivity of the conductor layer 30 decreases. Therefore, the baking temperature of the conductor layer 30 is preferably 250° C. or more and 600° C. or less as described above.

According to the foregoing method, as described above, since the formation of the dielectric layer 20 can be carried out simultaneously with the formation of the conductor layer 30, it is industrially beneficial, such as process/cost reduction.

Figure 3D:
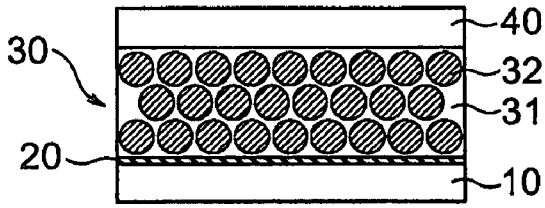

Thereafter, as shown in FIG. 3D, a metal layer is formed on the conductor layer 30 as the second electrode layer 40 by a vacuum deposition method, a sputtering method, a plating method, or the like. Alternatively, a conductive paste such as a silver paste may be coated on the conductor layer 30.

When the element according to this invention is used as a decoupling element, direct current is supplied to the conductor layer 30 and the second electrode layer 40. In consideration of this, the thicknesses of the conductor layer 30 and the second electrode layer 40 should be set to values such that their combined resistance becomes several mΩ. As one example, the conductor layer 30 is 0.5 μm and the second electrode layer 40 is approximately 10 μm.

Figure 3E:
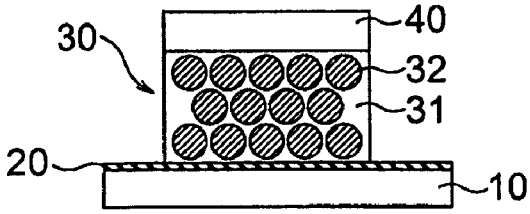

After the formation of the second electrode layer 40, patterning is carried out by the use of a metal mask, a photomask, or the like and unnecessary portions are removed by etching, thereby forming a desired stripline shape as shown in FIG. 3E.

Next, referring to FIG. 4, the second embodiment of this invention will be described. In the second embodiment, an element according to this invention is formed on a semiconductor substrate.

Figure 4:
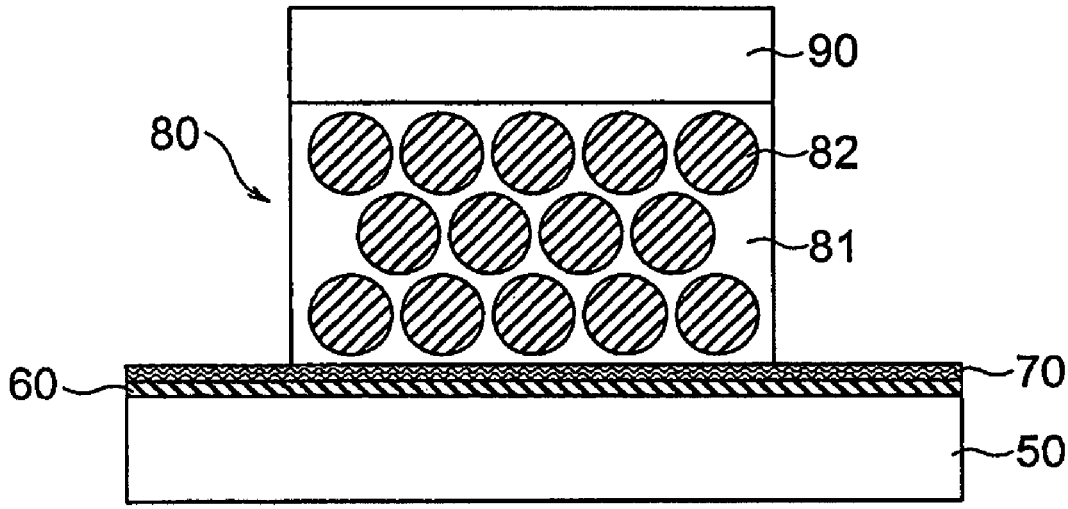
FIG. 4 is a sectional view of an element according to a second embodiment of this invention.

FIG. 4 is a sectional view of the element according to the second embodiment of this invention. A first electrode layer 60, a dielectric layer 70, a conductor layer 80, and a second electrode layer 90 are stacked on a semiconductor substrate 50. The conductor layer 80 is composed of a binder layer 81 made of a conductive polymer or an organic-inorganic hybrid resin and conductive nanoparticles 82 uniformly dispersed in the binder layer.

The semiconductor substrate 50 may be a semiconductor wafer generally used currently, such as silicon or gallium arsenide, but it goes without saying that another semiconductor wafer, such as silicon germanium, indium phosphide, gallium nitride, or silicon carbide, raises no problem. On this semiconductor substrate 50, a single-layer film of a metal that is stable alone, such as platinum, gold, titanium, or tungsten, or a laminate film thereof is formed as the first electrode layer 60 by a vacuum deposition method, a sputtering method, or the like.

Thereafter, the dielectric layer 70 is formed by a CVD method, a sputtering method, or the like. The dielectric layer 70 to be formed is silicon oxide, silicon nitride, silicon oxynitride, STO ($SrTiO_3$), BST ($BaSrTiO_3$), or PZT ($PbZrTiO_3$). However, the material is not limited thereto and is desirably a material having as high a relative permittivity as possible, and its thickness is preferably approximately several nm to 100 nm. Further, the forming method of the dielectric layer 70 is also not limited to the CVD method or the sputtering method, but may be another method as long as it can form a dielectric thin film.

Thereafter, a mixture for forming the conductor layer 80 is coated by spin coating and then baked, thereby forming the conductor layer 80. The conductor layer 80 comprises the binder layer 81 and the conductive nanoparticles 82.

Thereafter, by the use of a photolithography process, a dry etching process, a wet etching process, a milling process, and so on, the dielectric layer 70 and the conductor layer 80 are patterned into a desired stripline structure.

After the patterning, a single-layer film of a metal that is stable alone or that is stable after oxidation or sulfidization at its surface, such as platinum, gold, silver, copper, aluminum, titanium, or tungsten, or a laminate film thereof is formed on the conductor layer 80 as the second electrode layer 90 by a vacuum deposition method, a sputtering method, a plating method, or the like.

When the element according to this invention is used as a decoupling element, direct current is supplied to the conductor layer 80 and the second electrode layer 90. In consideration of this, the thicknesses of the conductor layer 80 and the second electrode layer 90 should be set to values such that their combined resistance becomes several mΩ.

EXAMPLES

Next, referring to FIGS. 3A to 3E, the fabrication method of the element according to the first embodiment will be described in terms of a specific Example.

At first, although not illustrated, a mixture for forming the conductor layer 30 is prepared. This mixture is formed by mutually dispersing 7 weight parts of Silicone B8248 (manufactured by Toshiba Silicones) being the material of the binder layer 31, 65 weight parts of the tin oxide nanoparticles 32 (manufactured by Mitsubishi Materials Corporation), and 28 weight parts of glass particles. The dispersion was carried out by the use of a three-roll mill.

Then, the first electrode layer 10 made of titanium foil was prepared (FIG. 3A) and the mixture for forming the conductor layer 30 was coated thereon by bar coating (FIG. 3B). Thereafter, the mixture coated on the first electrode layer 10 was baked at 500° C., thereby forming the conductor layer 30 and, simultaneously, the surface of the titanium foil, being the first electrode layer 10, contacting the conductor layer 30 was oxidized, thereby forming the dielectric layer 20 (FIG. 3C). In this event, the thickness of the conductor layer 30 was 0.5 μm.

Thereafter, gold was vacuum-deposited on the conductor layer 30, thereby forming the second electrode layer 40 (FIG. 3D). In this event, the thickness of the second electrode layer 40 was approximately 10 μm and its size was 1×30 mm.

The fabricated element was evaluated as a capacitor, wherein the capacitance was 2 μF.

S-parameters of the microstrip line thus fabricated were evaluated by a network analyzer, wherein S21 was −51 dB at 1 MHz, −91 dB at 10 MHz, and −110 dB or less at 100 MHz or more. The value of −110 dB is a measurement limit of the measuring device and, actually, it was not possible to evaluate accurate values smaller than −110 dB.

Next, referring to FIG. 4, the fabrication method of the element according to the second embodiment will be described in terms of a specific Example.

The first electrode layer 60 made of gold, the dielectric layer 70 made of STO, the conductor layer 80, and the second electrode layer 90 made of gold are stacked on the silicon substrate 50. The conductor layer 80 is made of the same materials as those of the conductor layer 30 in the first embodiment.

On the silicon substrate 50, gold was formed as the first electrode layer 60 by a vacuum deposition method. Thereafter, as the dielectric layer 70, STO was formed into a film of 10 nm by a sputtering method. Thereafter, the mixture for forming the conductor layer 80 was coated by spin coating and then baked, thereby forming the conductor layer 80. On the conductor layer 80, gold was formed as the second electrode layer 90 by a vacuum deposition method.

Thereafter, the dielectric layer 70 and the conductor layer 80 were patterned into a desired stripline structure with 10 μm×300 μm by a photolithography process and a dry etching process.

The fabricated element was evaluated as a capacitor, wherein the capacitance was 1 nF.

The invention claimed is:

1. A microstrip line having at least a dielectric layer and a conductor layer disposed in order on a first electrode layer, said microstrip line characterized in that said dielectric layer is formed by oxidizing, nitriding, or oxynitriding said first electrode layer, and said conductor layer comprises at least conductive nanoparticles and a binder resin.

2. A microstrip line according to claim 1, characterized in that said conductive nanoparticles contain at least one of gold, silver, copper, silver oxide, copper oxide, tin oxide, zinc oxide, and indium oxide, an average particle diameter of said conductive nanoparticles is 1 nm or more and 500 nm or less, and the content of said conductive nanoparticles in said conductor layer is 10 wt % or more and less than 100 wt %.

3. A microstrip line according to claim 1 or 2, characterized in that a characteristic impedance is 1Ω or less.

4. A microstrip line according to claim 1 or 2, characterized in that a second electrode layer is disposed on said conductor layer.

5. A method of fabricating the micro strip line according to claim 1 or 2, characterized by forming said conductor layer on said first electrode layer and forming said dielectric layer between said first electrode layer and said conductor layer by carrying out heat treatment at a temperature of 250° C. or more and 600° C. or less.

6. A method of fabricating the microstrip line according to claim 1 or 2, characterized in that said dielectric layer is formed between said first electrode layer and said conductor layer by oxidizing, nitriding, or oxiynitriding said first electrode layer after forming said conductor layer on said first electrode layer.

* * * * *